United States Patent [19]

Dennard

[11] Patent Number: 4,610,038

[45] Date of Patent: Sep. 9, 1986

[54] HAT/TOTE BAG COMBINATION ARTICLE

[76] Inventor: David G. Dennard, 50 Herron Cove Rd., Weaverville, N.C. 28787

[21] Appl. No.: 740,570

[22] Filed: Jun. 3, 1985

[51] Int. Cl.[4] ..... A42B 1/20

[52] U.S. Cl. ..... 2/209.1; 2/185 R; 2/196

[58] Field of Search ..... 2/209.1, 199, 185 R, 2/209.3, 196

[56] References Cited

U.S. PATENT DOCUMENTS

| | | | |
|---|---|---|---|
| 3,011,173 | 12/1961 | Goetz | 2/196 |
| 3,260,292 | 7/1966 | Costello | 2/209.3 A |
| 3,275,106 | 9/1966 | Rush | 2/209.1 |
| 3,818,158 | 6/1974 | Nakanishi | 2/209.1 |
| 4,165,542 | 8/1979 | McLaughlin | 2/209.1 |
| 4,472,837 | 9/1984 | Saxton | 2/209.1 |

FOREIGN PATENT DOCUMENTS

| | | | |
|---|---|---|---|
| 412335 | 7/1910 | France | 2/196 |
| 1507338 | 12/1967 | France | 2/196 |
| 866395 | 12/1952 | German Democratic Rep. | 2/209.1 |
| 552569 | 12/1956 | Italy | 2/209.1 |
| WO83/03527 | 10/1983 | PCT Int'l Appl. | 2/209.1 |

OTHER PUBLICATIONS

Gershman, *Journal of A.M.A.,* vol. 168, No. 7, 10/1958, "Self-Adhering Nylon Tapes", p. 980.

*Primary Examiner*—Werner H. Schroeder
*Assistant Examiner*—Mary A. Ellis

[57] ABSTRACT

A hat/tote bag combination article formed from a tubular member having a body portion with two closed ends and a rim encircling and affixed to the body portion near one closed end. The article serves as a tote bag in the normal condition and selectively as a hat when everted.

9 Claims, 3 Drawing Figures

HAT/TOTE BAG COMBINATION ARTICLE

BACKGROUND OF THE INVENTION

The present invention relates to a combination article which functions as a hat and tote bag. It more particularly relates to a tubular member having a body portion and two closed ends which function as a tote bag when the hat brim is enveloped therein and when everted serves as a hat when part of the body portion and one closed end are folded and nested within the other.

A number of prior art patents disclose a head covering which functions alternatively as a bag or a carrying case. See, for example, U.S. Pat. Nos. 4,165,542 and 3,011,173. However, no prior art reference disclosing an article functioning as a hat and carrying bag like the present invention has been noted. There is a need for a combination article having such versatility, and the present invention fully meets that need in a convenient, durable and inexpensive manner.

SUMMARY AND OBJECTIVES OF THE INVENTION

A first object of the present invention is to provide a combination article used alternatively as a tote bag and a hat which is designed in such a manner to expose the article to be used and conceal elements of the unused article by enveloping and nesting the unused article elements in a section of the article to be used.

A second object of the present invention is to provide an article of the type described that is easy to construct, readily changeable from one article to the other, and durable in structure.

Another object of the present invention is to provide a unitary combination of alternative articles that have functional closure and carrying means for the convenience of the user.

FIGURE DESCRIPTION

Other objects and advantaeous features of the present invention will become more apparent from the following detailed description taken in conjunction with the accompanying drawings wherein like characters of reference designate like parts throughout the several views and wherein:

FIG. 1 is a perspective view of the combination article comprising the present invention showing the bag body portion everted to expose the hat brim and conceal the carrying straps of the tote bag;

FIG. 2 is a perspective view disclosing the body portion in the normal, noneverted condition wherein the brim is concealed and the carrying straps are conveniently exposed and positioned for use in close proximity to the bag closure means; and FIG. 3 is a perspective view of the combination article comprising the present invention showing the bag body portion reversed and being enveloped within the hat.

DETAILED DESCRIPTION OF PREFERRED EMBODIMENT

Figure 2:
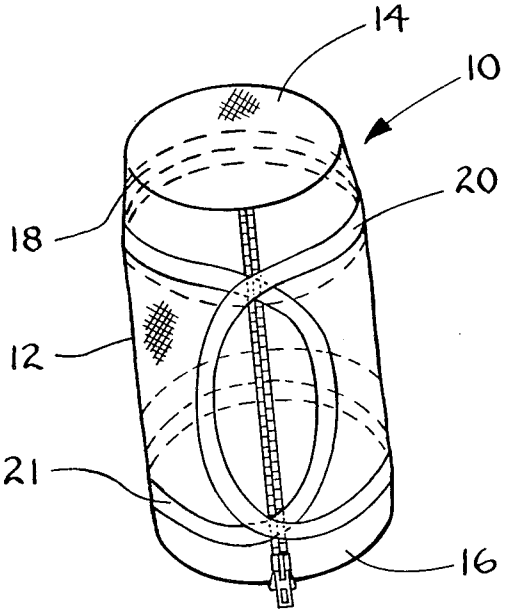

Referring now to the drawings and particularly to FIG. 2, there is shown a tubular member forming a tote bag shown generally as 10 having a body portion 12 and first and second closed ends 14 and 16, preferably formed of a pliable material. On the inside of the body portion 12 is a hat brim 18 shown in hidden lines which encircles and is affixed to body portion 12 near first closed end 14 by sewing or other appropriate means. Straps 20 are fastened, preferably by sewing, to the outside of body portion 12 to provide a convenient mode for carrying the bag.

Figure 1:
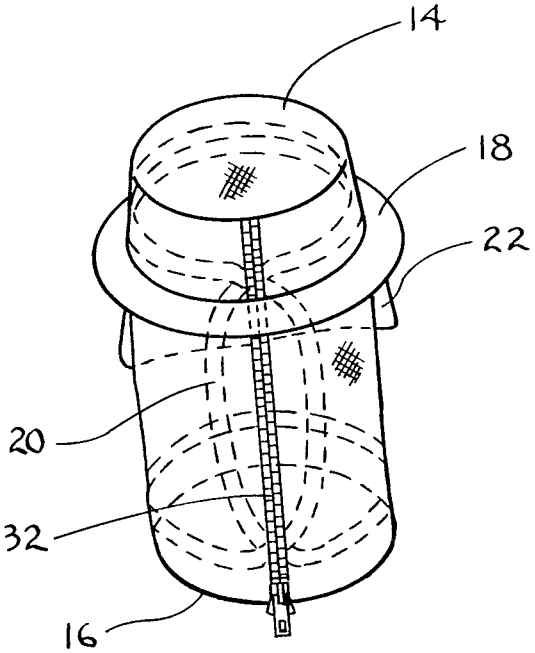

When bag 10 is everted (FIG. 1), the brim 18 becomes outwardly visible and encircles body porton 12 near first closed end 14. The carrying straps 20 are enveloped within the interior of the body portion upon eversion.

Figure 3:
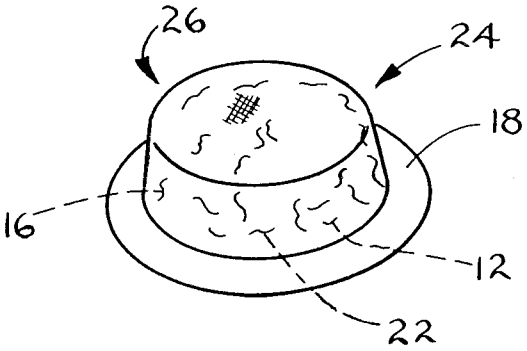

In FIG. 3, most of the body portion 12 and the second closed end 16 are enveloped and nested within a part of body portion 12 and first closed end 14 to form a hat shown generally as 24. Body portion 12 and second end 16 do not interfere with the use of a part portion of body portion 12 and end 14 forming the crown shown generally as 26 of the hat when the article is in use. They are merely pushed into the hat crown 26 and compacted when the hat is placed on the head of the wearer. The location 27 where the encircling brim 18 is affixed to the body portion 12 creates the folding line along which part of body portion 12 and second closed end 16 are folded into and nested within the other part of body portion 12 and first closed end 14.

A zipper 32 or other suitable securing means may be used to close the tote bag 10, and obviously the straps 20 forming the carrying means can take any number of convenient and usable forms.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A hat/tote bag combination article comprising: a tubular member having a body portion and first and second closed ends, part of said body portion and said first closed end forming a crown said body portion having an encircling brim secured thereto thereby functioning as a hat when a part of said body portion and said second closed end are folded into and nested within said crown.

2. The combination as claimed in claim 1 wherein said body portion and said first and second closed ends serve as a tote bag when everted to envelop said brim.

3. The combination as claimed in claim 1 wherein said tote bag has closure means.

4. The combination as claimed in claim 2 wherein said tote bag has carrying means.

5. The combination as claimed in claim 2 wherein said tote bag has closure means.

6. A reversible tote bag comprising: a tubular body portion having and first and second closed ends; a brim encircling and secured to said body portion proximate said first closed end so that a part of said body portion, said first closed end, and said brim thereby functions as a hat when said tote bag is everted and said other body portion part and second closed end are folded into and nested within said first closed end.

7. The article as claimed in claim 6 wherein said tote bag has closure means.

8. The article as claimed in claim 6 wherein said tote bag has carrying means.

9. The article as claimed in claim 2 wherein said tote bag has closure and carrying means.

* * * * *